US006187064B1

(12) United States Patent
Henderson

(10) Patent No.: US 6,187,064 B1
(45) **Date of Patent: *Feb. 13, 2001**

(54) UNLEADED AVIATION GASOLINE

(75) Inventor: Douglas H. Henderson, Glen Allen, VA (US)

(73) Assignee: Ethyl Petroleum Additives, Inc., Richmond, VA (US)

( * ) Notice: Under 35 U.S.C. 154(b), the term of this patent shall be extended for 0 days.

This patent is subject to a terminal disclaimer.

(21) Appl. No.: 08/312,048

(22) Filed: Sep. 26, 1994

Related U.S. Application Data

(63) Continuation of application No. 08/011,262, filed on Jan. 29, 1993, now abandoned, which is a continuation-in-part of application No. 07/783,210, filed on Oct. 28, 1991, now abandoned.

(51) Int. Cl.[7] ..... C10L 1/18
(52) U.S. Cl. ..... 44/359; 44/449
(58) Field of Search ..... 44/359, 449

(56) References Cited

U.S. PATENT DOCUMENTS

| | | | | |
|---|---|---|---|---|
| 2,391,084 | * | 12/1945 | Carmody | 44/449 |
| 2,409,746 | * | 10/1946 | Evans et al. | 44/449 |
| 3,127,351 | * | 3/1964 | Brown et al. | 44/359 |
| 3,197,414 | * | 7/1965 | Wood | 44/359 |
| 3,272,606 | * | 9/1966 | Brown et al. | 44/359 |
| 3,755,195 | * | 8/1973 | Hnizda | 44/359 |
| 4,141,693 | * | 2/1979 | Feldman et al. | 44/359 |
| 4,182,913 | * | 1/1980 | Takezono et al. | 44/449 |
| 4,252,541 | * | 2/1981 | Herbstman | 44/449 |
| 5,210,326 | * | 5/1993 | Marquez et al. | 44/449 |

FOREIGN PATENT DOCUMENTS

| | | |
|---|---|---|
| 0466511 | 1/1992 | (EP) . |
| 2186287 | 8/1987 | (GB) . |

OTHER PUBLICATIONS

Kirk–Othmer "Encyclopedia of Chemical Technology," 3d Ed., vol. 3, John Wiley & Sons, New York, p. 332 (date unknown).

Nelson "Petroleum Refinery Engineering," 4th Ed., McGraw–Hill, New York, p. 34; tables 3–6, 1958.

ASTM Specifications D910–90, "Standard Specification for Aviation Gasolines," pp. 283–289, Nov. 1990.

* cited by examiner

*Primary Examiner*—Jerry D. Johnson
(74) *Attorney, Agent, or Firm*—Dennis H. Rainear; Thomas Hamilton; James T. Moore

(57) ABSTRACT

Unleaded aviation gasolines of enhanced properties are described. They satisfy at least the octane and heat content specifications of ASTM D 910-90. Also described are unleaded aviation gasolines which satisfy all of the specifications of ASTM D 910-90. The fuels also prevent or at least inhibit exhaust valve recession or wear during use in aviation engines, especially those designed to operate on leaded aviation fuel. The fuels of the invention contain a cyclopentadienyl manganese tricarbonyl compound. Preferably the fuels are made up of a blend of at least about 80% by volume of aviation alkylate gasoline, up to about 10% by volume of a gasoline-soluble dialkyl ether gasoline blending agent, from about 0.25 to about 0.60 grams of manganese per gallon as at least one cyclopentadienyl manganese tricarbonyl compound, and optionally up to about 15% by volume of aromatic gasoline hydrocarbons, these being proportioned such that the fuel possesses at least the octane qualities and heat contents called for by ASTM Specification D 910-90.

11 Claims, No Drawings

UNLEADED AVIATION GASOLINE

This application is a continuation of application Ser. No. 08/011,262, filed Jan. 29, 1993, now abandoned which in turn is a continuation in part of prior application Ser. No. 07/783,210, filed Oct. 28, 1991, now abandoned.

This invention relates to unleaded aviation gasoline compositions which satisfy the specification requirements of ASTM Specification D 910-90. More particularly, this invention provides unleaded high octane aviation gasoline compositions which will operate as well as, if not better than, present-day aviation gasolines. Additionally, this invention accomplishes this exceptionally important advantage on an economical basis, while at the same time conserving worldwide petroleum resources.

The specifications imposed upon aviation gasolines are necessarily extremely rigorous. Use of an off-specification motor gasoline in a passenger car or truck can, at worse, result in poor engine performance, stalling, or other operational problem which, while annoying, are normally not life-threatening. In contrast, if an aviation gasoline does not perform properly in a spark-ignition aviation engine, the consequences could be disastrous.

While leaded aviation gasolines have performed wonderfully well in actual service for many years*, many misguided persons have clamored for elimination of lead from gasoline. If their efforts succeed, the refining industry will be faced with the problem of trying to provide unleaded aviation gasoline that performs as well as leaded aviation gasoline and that does not exceed the economic constraints of the marketplace.

* It may well be remembered that leaded aviation gasoline was deemed at least partially responsible for the successful Battle of Britain.

Besides providing aviation fuels having the necessary octane quality, a particular problem which exists when attempts are made to eliminate use of alkyllead antiknock compounds in aviation gasoline base fuels otherwise satisfying the specification requirements of aviation gasoline, is valve seat recession, especially in aviation piston engines that were designed and manufactured to operate on leaded fuels.

As pointed out in U.S. Pat. No. 4,659,338, the problem of exhaust valve recession has been observed heretofore in connection with tractors, automobiles, and outboard motors. The problem in automotive engines was specifically addressed in U.S. Pat. No. 3,955,938 through incorporation in unleaded motor gasoline of a gasoline-dispersible sodium additive. The patent describes results of road tests with a 1970 Chrysler passenger car and a 1970 Ford motor car operated on such fuels. However, according to U.S. Pat. No. 4,659,338, sodium salts of organic acids have a tendency to emulsify water into gasoline, and with some sodium salts and undesirable extraction of the sodium into the water occurs. The approach suggested in this latter patent for overcoming the exhaust valve recession or wear problem is to include in the gasoline the combination of at least one hydrocarbon-soluble alkali or alkaline earth metal-containing composition and at least one hydrocarbon-soluble ashless dispersant. This suggestion may prove useful in connection with operation of land-based vehicles. However, in view of the careful control that must be imposed on aviation gasolines as regards fuel volatility, vapor pressure, potential gum content, dispersed particulates, etc., it is not likely that such additive combinations will comply with current specifications for aviation gasoline usage.

Thus a need exists for a way of economically achieving the dual objectives of meeting the octane quality needed for aviation gasoline and preventing or at least inhibiting exhaust valve recession or wear during the operation of aviation engines on unleaded aviation gasolines.

This invention is deemed to fulfill the above need and overcome the above problems most expeditiously.

In accordance with this invention, there is provided an unleaded aviation gasoline composition which comprises a blend of hydrocarbons and at least one cyclopentadienyl manganese tricarbonyl compound dissolved therein in an amount such that said gasoline composition has a minimum knock value lean rating octane number of 100 as determined by ASTM Test Method D 2700 and wherein Motor Method octane ratings are converted to aviation ratings in the manner described in ASTM Specification D 910-90, said composition being further characterized by having: a) a distillation temperature as determined by ASTM Test Method D 86 of 10% evaporated, 167° F. maximum temperature; 40% evaporated, 167° F. maximum temperature; 90% evaporated, 275° F. maximum temperature; and a final boiling point of 338° F. maximum temperature; the sum of the 10 and 50% evaporated temperatures being 307° F. minimum; the distillation recovery being 97% minimum; the distillation residue being 1.5% maximum; and the distillation loss being 1.5% maximum; b) a heat of combustion as determined by ASTM Test Method D 1405 and as calculated from Table 1 thereof of 18,720 btu per pound minimum, or a heat of combustion as determined by ASTM Test Method D 2382 of 18,700 btu per pound minimum, the latter method controlling in case of a discrepancy therebetween; c) a vapor pressure as determined by ASTM Test Method D 323 or D 2551 of 5.5 psi minimum and 7.0 psi maximum; d) a copper strip corrosion as determined by ASTM Test Method D 130 of number 1, maximum; e) a potential gum (5-hour aging gum) as determined by ASTM Test Method D 873 of 6 mg per 100 mL maximum, or a potential gum (16-hour aging gum as determined by ASTM Test Method D 873) of 10 mg per 100 mL; f) a sulfur content as determined by ASTM Test Method D 1266 or D 2622 of 0.05% by weight maximum; g) a freezing point as determined by ASTM Test Method D 2386 of −72° F. maximum; and h) a water reaction as determined by ASTM Test Method D 1094 wherein the volume change, if any, does not exceed ±2 mL.

Base fuels meeting the foregoing specifications are routinely produced by a number of petroleum refiners. Virtually any major U.S. petroleum refiner has the existing capability of supplying base fuels meeting these specifications. Indeed, at airports all around the country, well known brands of leaded aviation gasolines made from base gasolines meeting these requirements are used to fuel piston-engine aircraft that operate on aviation gasoline. Most aviation gasolines currently contain the tetraethyllead antiknock mixture. Petroleum refiners could of course, eliminate the use of such tetraethyllead antiknock mixture and thereby provide the corresponding unleaded base fuel. No new technology would be required to produce such base fuels. However, such unleaded base fuels could not be used to safely operate aircraft powered by gasoline-engines—the octane quality of the fuel would be too low and the risk of valve seat recession or wear, especially in older aircraft currently in widespread use, would be too high. Accordingly, in the absence of this invention, elimination of the tetraethyllead mixture from aviation gasoline would be expected to necessitate significant changes in the refining and blending of aviation gasolines in order to achieve high enough octane quality to satisfy the octane requirements of aviation engines to be operated on such fuels. This in turn would most likely necessitate more rapid depletion of worldwide petroleum resources and result in marked increases in the cost of aviation gasolines. So far as is known, the present invention is the only economical way of providing aviation gasolines having the requisite octane quality to satisfy aviation engine requirements plus the added protection of decreased exhaust valve recession. At the same time, none of the current specifications on aviation gasoline base fuels and none of the current manufacturing and blending procedures for producing aviation gasoline base fuels would need to be changed.

Preferred gasoline compositions are those in which the gasoline composition additionally has a minimum performance number reported to the nearest whole number and as determined by ASTM Test Method D 909 of 130. In this connection, a minimum performance number of 130 is equivalent to a knock value determined using isooctane plus 1.28 milliliters of tetraethyllead per gallon.

Another embodiment of this invention provides the method of operating a four stroke cycle, reciprocating piston aircraft engine which comprises providing or using as the fuel for said engine a gasoline composition of this invention.

Still another embodiment of this invention provides, in combination, at least one four stroke cycle, reciprocating piston aircraft engine and at least one fuel storage tank operatively connected with said at least one engine so as to deliver fuel required to operate said engine, said at least one fuel storage tank containing a gasoline composition of this invention as the fuel for said engine.

Cyclopentadienyl manganese tricarbonyl compounds which can be used in the practice of this invention include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of such compounds is described in the literature, for example, U.S. Pat. No. 2,818,417, disclosure of which is incorporated herein in toto.

In another preferred embodiment the unleaded gasoline composition additionally contains at least one antioxidant in an amount not in excess of 8.4 pounds per 1000 barrels, said antioxidant being selected from the group N,N'-diisopropyl-p-phenylenediamine, N,N'-di-sec-butyl-p-phenylenediamine, 2,4-dimethyl-6-tert-butylphenol, 2,6-di-tert-butyl-4-methylphenol, 2,6-di-tert-butylphenol, a mixture of 75% minimum 2,6-di-tert-butylphenol plus 25% maximum di- and tri-tert-butylphenol; and a mixture of 75% minimum di- and tri-isopropyl phenols plus 25% maximum di- and tri-tert-butylphenol. Most preferably the amount of such antioxidant does not exceed 4.2 pounds per 1000 barrels.

It is to be understood that the fuels of this invention are unleaded in the sense that a lead-containing antiknock agent is not deliberately added to the gasoline. Trace amounts of lead due to contamination of equipment or like circumstances are permissible and are not to be deemed excluded from the practice of this invention.

The base fuels used in the foregoing compositions can be blends of refined hydrocarbon derived from crude petroleum, natural gasoline, or blends thereof with synthetic hydrocarbons or aromatic hydrocarbons, or both. Blending components, if approved for use in aviation gasolines, such as oxygenated ingredients or the like, can be included. The most preferred oxygenated ingredients are the fuel-soluble dialkyl ethers containing up to about 8 carbon atoms per molecule, especially methyl tertiary butyl ether, ethyl tertiary butyl ether, tertiary amyl methyl ether, and the like. Rarely, if ever, will the content of aromatic hydrocarbons in the gasoline exceed levels above 25%. As noted above, the overall composition must satisfy the requirements a) through h) inclusive as set forth above.

Other components which can be employed, and under certain circumstances are preferably employed, include dyes which do not contribute to excessive induction system deposits. Typical dyes which can be employed are 1,4-dialkylaminoanthraquinone, p-diethylaminoazobenzene (Color Index No. 11020) or Color Index Solvent Yellow No. 107, methyl derivatives of azobenzene-4-azo-2-naphthol (methyl derivatives of Color Index No. 26105), alkyl derivatives of azobenzene-4-azo-2-naphthol, or equivalent materials. The amounts used should, wherever possible, conform to the limits specified in ASTM Specification D 910-90.

Fuel system icing inhibitors may also be included in the fuels of this invention. Preferred are ethylene glycol monomethyl ether and isopropyl alcohol, although materials giving equivalent performance may be considered acceptable for use. Amounts used should, wherever possible, conform to the limits referred to in ASTM Specification D 910-90.

The concentration of the cyclopentadienyl manganese tricarbonyl compound used in the unleaded aviation gasoline base stock satisfying the above criteria will vary to some extent depending upon the identity and properties of the base fuel and the octane quality desired in the finished fuel. Ordinarily amounts equivalent to 0.01 to about 0.5 gram of manganese per gallon of fuel are sufficient, although higher amounts can be used whenever deemed necessary or appropriate, provided that the resultant fuel composition satisfies the requirements of a) through h) above. Preferably the fuel will contain up to about 0.25 gram of manganese per gallon as one or more cyclopentadienyl manganese tricarbonyl compounds. However, when the aviation fuel contains a gasoline-soluble dialkyl ether such as methyl tertiary butyl ether, ethyl tertiary butyl ether, tertiary amyl methyl ether, or the like, the aviation fuel preferably contains from about 0.25 to about 0.60 and more preferably, from about 0.3 to about 0.5 grams of manganese per gallon as one or more cyclopentadienyl manganese tricarbonyl compounds.

There are good and sufficient reasons why the gasoline composition is to comply with the requirements set forth above as a) through h). The rationale behind these requirements as set forth in ASTM Specification D 910-90 are as follows:

> "X1.1.1. Aviation gasoline is a complex mixture of relatively volatile hydrocarbons that vary widely in their physical and chemical properties. The engines and aircraft impose a variety of mechanical, physical, and chemical environments. The properties of aviation gasoline . . . must be properly balanced to give satisfactory engine performance over an extremely wide range of conditions.

X1.1.3. Specifications covering antiknock quality define the grades of aviation gasoline. The other requirements either prescribe the proper balance of properties to ensure satisfactory engine performance or limit components of undesirable nature to concentrations so low that they will not have an adverse effect on engine performance.

X1.2.1. The fuel-air mixture in the cylinder of a spark-ignition engine will, under certain conditions, ignite spontaneously in localized areas instead of progressing from the spark. This may cause a detonation or knock, usually inaudible in aircraft engines. This knock, if permitted to continue for more than brief periods, may result in serious loss of power and damage to or destruction of the aircraft engine. When aviation gasoline is used in other types of aviation engines, for example, in certain turbine engines where specifically permitted by the engine manufacturers, knock or detonation characteristics may not be critical requirements."

In accordance with other preferred embodiments this invention further provides:

A) The method of operating a four stroke cycle, reciprocating piston aircraft engine which comprises providing and/or using as the fuel for said engine a gasoline composition of this invention, and providing and/or using as the lubricating oil for said engine a lubricating oil composition satisfying the chemical and physical property requirements set forth below; and B) Apparatus which comprises in combination (i) at least one four stroke cycle, reciprocating piston aircraft engine, (ii) at least one fuel storage tank operatively connected with said at least one engine so as to deliver fuel required to operate said engine, and (iii) at least one chamber in said engine for receiving and maintaining a supply of lubricating oil for lubricating said engine during operation thereof, said at least one fuel storage tank containing a gasoline composition of this invention as the fuel for said engine and said at least one chamber containing as the lubricating oil for said engine a lubricating oil composition satisfying the chemical and physical property requirements set forth below.

The chemical and physical property requirements of the lubricating oil used In the foregoing preferred embodiments A) and B) are as follows:

1) Viscosity, cSt, per ASTM D 445:

| SAE Grade | Minimum at 100° C. | Less than at 100° C. |
|---|---|---|
| 30 | 9.3 | 12.5 |
| 40 | 12.5 | 16.3 |
| 50 | 16.3 | 21.9 |
| 60 | 21.9 | 26.1 |

2) Multigrade oil shall meet the viscosity requirements and the Low Temperature Viscosity Cold Crank Simulation requirements of SAE Test Method J300 for the designated grade.

3) Viscosity Index, minimum per ASTM D 2270: 100 for SAE grades 30, 40 and Multigrade; 95 for SAE grades 50 and 60.

4) Flash Point, ° C., minimum per ASTM D 92: 220 for SAE grades 30 and Multigrade; 225 for SAE grade 40; and 243 for SAE grades 50 and 60.

5) Pour Point, ° C., maximum per ASTM D 97: −24 for SAE grade 30; −22 for SAE grade 40; and −18 for SAE grades 50 and 60.

6) Viscosity, High Temperature, High Shear at 150° C., cP, minimum per ASTM D 4683, D 4741, D 4624: 3.3 for all viscosity grades.

7) Total Acid Number, mg KOH/g, maximum (titrated to a pH 11 end point) per ASTM D 664: 1.0 for all viscosity grades.

8) Ash Content, Mass %, maximum per ASTM D 482: 0.006 for all viscosity grades.

9) Trace Sediment, mL/100 mL Oil, maximum per ASTM D 2273: 0.005 for all viscosity grades.

10) Copper Strip Corrosion, maximum rating per ASTM D 130: 1 after 3 hours @ 100° C. for all viscosity grades; and 3 after 3 hours @ 204° C. for all viscosity grades.

11) Foaming Tendency/Stability per ASTM D 892: Aerated Volume, mL, maximum for all viscosity grades per Sequences I, II and III: 50; Volume after 10 minutes, mL, maximum for all viscosity grades per Sequences 1, II, and III: 0.

12) Compatibility with other oils per FTM 791 Method 3403: All viscosity grades shall pass.

13) Elastomer Compatibility, % swelling, acceptable range for all viscosity grades after 72 hours per FTM 791 Method 3604 (except conducted with the specific materials and temperatures herein listed):

| Material | Test Temperature | Acceptable Limits |
|---|---|---|
| AMS-3217/1 | 70° C. (158° F.) | −5 to +5 |
| AMS-3217/4 | 150° C. (302° F.) | −5 to +5 |
| AMS-3217/5 | 150° C. (302° F.) | −5 to +5 |
| US Navy Silicone Rubber | 121° C. (250° F.) | 0 to +20 |

14) Trace Metal Content, ppm, maximum for all viscosity grades, per test method of Paragraph 4.5.2 of MIL-L-22851D (Dec. 1, 1990) or equivalent: Iron, 5; Silver, 3; Aluminum, 7; Chromium, 5; Copper, 3; Magnesium, 3; Nickel, 3; Lead, 5; Silicon, 25; Tin, 10; Titanium, 2; Molybdenum, 4.

The most preferred lubricating oils will not only meet the above requirements 1) through 14) but in addition, will meet the following L-38 Engine Test Requirements:

15) Total Bearing Weight Loss, mg, maximum per ASTM STP 509A, Part IV for all viscosity grades: 500.

16) Used Oil Viscosity, Stripped, maximum % Change @ 40° C. per ASTM D 445 for all single viscosity grades: −15 to +10.

17) Used Oil Viscosity at 100° C. of Multi-grade Oil per SAE J300 shall remain in SAE J300 grade.

18) Used Oil Total Acid Number, maximum change for all viscosity grades per ASTM D 664 (titrated to a pH 11 end point): 2.0.

Aviation engine lubricating oils meeting the requirements necessary for such usage are available as articles of commerce from a number of well known suppliers of formulated lubricating oil compositions. A few commercially available aviation lubricating oils suitable for use in accordance with various manufacturers'specifications include Mobil AV 1 20W-50 aviation oil available from Mobil Oil Company; Phillips 66 X/C 20W-50 aviation oil available from Phillips Petroleum Company; and a line of aviation oils sold under the Aeroshell trademark of Shell Oil Company such as Aeroshell 15W-50 multigrade aviation oil, Aeroshell W100 SAE 50 aviation oil and Aeroshell W80 aviation oil. Included among the foregoing oils are formulations which are understood to satisfy the specifications set forth above.

Another feature of this invention is the excellent cooperation which exists as between ethers and cyclopentadienyl manganese tricarbonyl compounds when used conjointly in the aviation base fuel. Alkyl ethers, such as methyl tertiary butyl ether (MTBE), ethyl tertiary butyl ether (ETBE), tertiary amyl methyl ether (TAME), etc., which can be used as blending agents in gasolines in order to improve octane quality possess a substantial drawback when used in aviation fuels. This results from the fact that if used in amounts such as 15 volume % in an aviation base fuel (the amount required to achieve a substantial increase in octane quality in the absence of an antiknock agent), the heat content of the resultant fuel is reduced to such an extent that it is below the ASTM standards. This in turn means that the use of the ether at these levels substantially reduces the range of the aircraft, which obviously is a most undesirable result. However pursuant to this invention, amounts of such alkyl ethers of up to about 10 volume % can be used in the aviation fuel composition without fear of diminishing the range of the resultant aviation fuel, this result being due to the copresence in the fuel composition of the cyclopentadienyl manganese tricarbonyl compound. In other words, the alkyl ether and the cyclopentadienyl manganese tricarbonyl work together at concentrations below 10 volume % of the ether in the aviation fuel to provide a finished aviation fuel which possesses the necessary heat content to satisfy the ASTM specifications and at the same time possesses the octane quality necessary to satisfy the performance requirements of the aircraft engine.

Accordingly, another embodiment of this invention is an unleaded aviation gasoline composition which comprises a blend of hydrocarbons, from 1 to 10 volume % of at least one gasoline soluble alkyl ether having up to about 8 carbon atoms in the molecule, and at least one cyclopentadienyl manganese tricarbonyl compound dissolved therein in an amount such that said gasoline composition has a minimum knock value lean rating octane number of 100 as determined by ASTM Test Method D 2700 and wherein Motor Method octane ratings are converted to aviation ratings in the manner described in ASTM Specification D 910-90, said composition being further characterized by having:

a) a distillation temperature as determined by ASTM Test Method D 86 of 10% evaporated, 167° F maximum temperature; 40% evaporated, 167° F. maximum temperature; 90% evaporated, 275° F. maximum temperature; and a final boiling point of 338° F. maximum temperature; the sum of the 10 and 50% evaporated temperatures being 307° F. minimum; the distillation recovery being 97% minimum; the distillation residue being 1.5% maximum; and the distillation loss being 1.5% maximum;

b) a heat of combustion as determined by ASTM Test Method D 1405 and as calculated from Table 1 thereof of 18,720 btu per pound minimum, or a heat of combustion as determined by ASTM Test Method D 2382 of 18,700 btu per pound minimum, the latter method controlling in case of a discrepancy therebetween;

c) a vapor pressure as determined by ASTM Test Method D 323 or D 2551 of 5.5 psi minimum and 7.0 psi maximum;

d) a copper strip corrosion as determined by ASTM Test Method D 130 of number 1, maximum;

e) a potential gum (5-hour aging gum) as determined by ASTM Test Method D 873 of 6 mg per 100 mL maximum, or a potential gum (16-hour aging gum as determined by ASTM Test Method D 873) of 10 mg per 100 mL;

f) a sulfur content as determined by ASTM Test Method D 1266 or D 2622 of 0.05% by weight maximum;

g) a freezing point as determined by ASTM Test Method D 2386 of −72° F. maximum; and h) a water reaction as determined by ASTM Test Method D 1094 wherein the volume change, if any, does not exceed ±2 mL.

In preparing the fuels of this invention which contain an ether octane-improving blending component such as MTBE, ETBE, TAME, etc., standard aviation alkylate is preferably used as the base stock. To achieve the necessary balance between octane quality and heat content (normally expressed in terms of btu per pound of fuel), a gasoline-soluble dialkyl octane-blending agent and a cyclopentadienyl manganese tricarbonyl compound are employed as ingredients in the aviation fuel. In many cases, it is desirable, but not necessary, to also add suitable aromatic gasoline hydrocarbons to the fuel composition in order to ensure that the composition possesses the requisite combination of properties.

For comparative purposes, there are presented in Table I the heat contents and octane qualities of typical individual blending components utilized in forming the finished fuels of this invention. In each case, the properties shown for the individual blending component are those possessed by the component when utilized in the absence of any other component or additive.

TABLE I

| Fuel Component | Heat Content, Net btu/lb | Motor Octane Number |
|---|---|---|
| Aviation Alkylate | 19,100 | 92 |
| Toluene | 17,426 | 93 |
| MTBE | 15,100 | 100 |
| ETBE | 15,500 | 102 |
| TAME | 15,700 | 98 |

In particular, the data in Table I show that the only component thereof having the requisite heat content to satisfy requirements of ASTM D 910 is the aviation alkylate. On the other hand, its octane quality is insufficient. On the other hand, the three ether blending agents have good octane qualities, but poor heat contents. The toluene, which exemplifies aromatic gasoline components, has a poorer heat content than the aviation alkylate, although it is still better than the heat contents of the ethers, and the octane quality of the toluene is not substantially better than that of the aviation alkylate.

When preparing the multicomponent blends of this invention, it is important to employ the components in the proper proportions in order to achieve the requisite properties such as described above. This is illustrated by the data in Table II which show the octane qualities and heat contents of three different fuel blends not of this invention. Fuel X is a blend of 50 volume % of a commercially-available aviation alkylate gasoline, 30 volume % of MTBE, and 20 volume % at toluene. Fuel Y is composed of the same components in the respective volume % proportions of 60, 30, and 10%. In Fuel Z, the same three components are in the proportions of 75, 15, and 10 volume %, respectively. Table II also presents the specification values set forth in the latest version of ASTM D 910. Each fuel blend contained 0.3 grams of manganese per gallon as methyl cyclopentadienyl manganese tricarbonyl.

TABLE II

| Fuel | Lean Octane Number Rating | Supercharge Performance Number | Heat Content, Net btu/lb |
|---|---|---|---|
| X | 99.3 | 159.1 | 17,564 |
| Y | 101.7 | 142.5 | 17,732 |
| Z | 98.9 | 127.8 | 18,332 |
| Specification | 100.0 | 130.0 | 18,720 |

It will be seen from Table II that none of the fuels achieved the desired combination of properties at the level of methyl cyclopentadienyl manganese tricarbonyl used.

The following Examples are illustrative of the practice of this invention in which all percentages are by volume.

EXAMPLE 1

A blend is formed from 85% Chevron aviation alkylate having a heat content of approximately 19,100 btu/lb, 5% of MTBE, 10% toluene, and methylcyclopentadienyl manganese tricarbonyl (MCMT) in amounts equivalent to 0.3, 0.4, and 0.5 grams of manganese per gallon. The heat content of the fuel is approximately 18,732 btu/lb.

EXAMPLE 2

A blend is formed from 88% Chevron aviation alkylate having a heat content of approximately 19,100 btu/lb, 6% of MTBE, 6% toluene, and methylcyclopentadienyl manganese tricarbonyl (MCMT) in amounts equivalent to 0.3, 0.4, and 0.5 grams of manganese per gallon. The heat content of the fuel is approximately 18,759 btu/lb.

EXAMPLE 3

A blend is formed from 92% Chevron aviation alkylate having a heat content of approximately 19,100 btu/lb, 8% of MTBE and methylcyclopentadienyl manganese tricarbonyl (MCMT) in amounts equivalent to 0.3, 0.4, and 0.5 grams of manganese per gallon. The heat content of the fuel is approximately 18,780 btu/lb.

EXAMPLE 4

A blend is formed from 90% Chevron aviation alkylate having a heat content of approximately 19,100 btu/lb, 5% of MTBE, 5% toluene, and methylcyclopentadienyl manganese tricarbonyl (MCMT) in amounts equivalent to 0.3, 0.4, and 0.5 grams of manganese per gallon. The heat content of the fuel is approximately 18,816 btu/lb.

Other suitable fuel compositions of this invention will now be readily apparent to those skilled in the art from a consideration of the foregoing disclosure.

In general, the aviation fuels of this invention should contain at least about 75 to about 80 volume % of aviation alkylate, less than about 10 volume % (preferably less than about 8 volume %, for example about 4 to about 8 volume %), of the dialkyl ether blending component, and optionally, up to about 15 volume % (preferably up to about 10 volume %) of aromatic gasoline hydrocarbons, at least a major proportion of which are mononuclear aromatic hydrocarbons such as benzene, toluene, xylenes, the mesitylenes, ethyl benzene, etc. The resultant blend should have a heat content of at least 18,700 btu/lb. These fuels should also contain an amount of one or more cyclopentadienyl manganese tricarbonyl compounds sufficient to provide the requisite octane number and valve seat wear performance characteristics.

This invention is susceptible to considerable variation. Thus it is not intended that this invention be limited by the specific exemplifications set forth hereinabove. Rather what is intended to be covered is the subject matter within the spirit and scope of the ensuing claims.

What is claimed is:

1. An unleaded aviation gasoline composition which comprises a blend of at least about 80% by volume of aviation alkylate gasoline, up to about 10% by volume of a gasoline-soluble dialkyl ether gasoline blending agent, from about 0.3 to about 0.5 grams of manganese per gallon as at least one cyclopentadienyl manganese tricarbonyl compound, and optionally up to about 15% by volume of aromatic gasoline hydrocarbons with the proviso that the components of said gasoline composition are selected and proportioned such that said gasoline composition possesses at least the following octane qualities and heat contents called for by ASTM Specification D 910-90: (a) a minimum knock value lean rating octane number of 100 as determined by ASTM Test Method D 2700 and wherein Motor Method octane ratings are converted to aviation ratings in the manner described in ASTM Specification D 910-90; and (b) a heat of combustion as determined by ASTM Test Method D 1405 and as calculated from Table 1 thereof of 18,720 Btu per pound minimum, or a heat of combustion as determined by ASTM Test Method D 2382 of 18,700 Btu Per pound minimum, the latter method controlling in case of a discrepancy therebetween.

2. A composition as claimed in claim 1 wherein said gasoline composition has a minimum knock value lean rating octane number of 100 as determined by ASTM Test Method D 2700 and a minimum performance number reported to the nearest whole number and as determined by ASTM Test Method D 909 of 130.

3. A composition as claimed in claim 1 wherein said cyclopentadienyl manganese tricarbonyl compound consists essentially of methylcyclopentadienyl manganese tricarbonyl.

4. A composition as claimed in claim 1 wherein said composition additionally contains at least one antioxidant in an amount not in excess of 8.4 pounds per 1000 barrels, said antioxidant being selected from the group N,N'-diisopropyl-p-phenylenediamine, N,N'-di-sec-butyl-p-phenylenediamine, 2,4-dimethyl-6-tert-butylphenol, 2,6-di-tert-butyl-4-methylphenol, 2,6-di-tert-butylphenol, a mixture of 75% minimum 2,6-di-tert-butylphenol plus 25% maximum di- and tri-tert-butylphenol; and a mixture of 75% minimum di- and triisopropyl phenols plus 25% maximum di- and tri-tert-butylphenol.

5. A composition as claimed in claim 1 wherein the amount of said antioxidant is not in excess of 4.2 pounds per 1000 barrels.

6. A composition in accordance with claim 1 wherein said dialkyl ether is methyl tertiary butyl ether.

7. A composition in accordance with claim 6 wherein said cyclopentadienyl manganese tricarbonyl compound is methylcyclopentadienyl manganese tricarbonyl.

8. A composition in accordance with claim 1 wherein said ether is present in an amount within the range of about 4 to about 8% by volume, and wherein said optional aromatic gasoline hydrocarbons, if present, are present in an amount of up to about 10% by volume.

9. A composition in accordance with claim 8 wherein said cyclopentadienyl manganese tricarbonyl compound is methylcyclopentadienyl manganese tricarbonyl.

10. A composition in accordance with claim 9 wherein said dialkyl ether is selected from the group consisting of methyl tertiary butyl ether, ethyl tertiary butyl ether, tertiary amyl methyl ether, and mixtures thereof.

11. A composition in accordance with claim 9 wherein said dialkyl ether is methyl tertiary butyl ether.

* * * * *